US011806852B2

(12) United States Patent
Ou

(10) Patent No.: US 11,806,852 B2
(45) Date of Patent: Nov. 7, 2023

(54) NAIL GUN NOZZLE MECHANISM AND NAIL GUN HAVING THE SAME

(71) Applicant: PANREX INDUSTRIAL CO., LTD., Taichung (TW)

(72) Inventor: Chen-Ho Ou, Taichung (TW)

(73) Assignee: PANREX INDUSTRIAL CO., LTD., Taichung (TW)

( * ) Notice: Subject to any disclaimer, the term of this patent is extended or adjusted under 35 U.S.C. 154(b) by 0 days.

(21) Appl. No.: 17/745,653

(22) Filed: May 16, 2022

(65) Prior Publication Data

US 2022/0371170 A1 Nov. 24, 2022

(30) Foreign Application Priority Data

May 19, 2021 (TW) ..... 110118129

(51) Int. Cl.
*B25C 1/04* (2006.01)

(52) U.S. Cl.
CPC ..... *B25C 1/047* (2013.01); *B25C 1/043* (2013.01)

(58) Field of Classification Search
CPC .. B25C 1/18; B25C 7/00; B25C 1/008; B25C 1/005; B25C 1/00; B25C 1/06; B25C 1/047; B25C 1/001; B25C 1/188
See application file for complete search history.

(56) References Cited

U.S. PATENT DOCUMENTS

2004/0050899 A1* 3/2004 Canlas ..... B25C 7/00 227/119
2018/0236647 A1* 8/2018 Ryan ..... B25C 1/003

* cited by examiner

*Primary Examiner* — Anna K Kinsaul
*Assistant Examiner* — Veronica Martin
(74) *Attorney, Agent, or Firm* — DLA PIPER LLP (US)

(57) ABSTRACT

A nail gun nozzle mechanism includes a clamping wall, a retaining wall, and a switch unit. The clamping wall defines a firing space. The retaining wall defines a withdrawn space that is in spatial communication with the firing space. The switch unit includes a linkage member, and a bracket member. The bracket member is movable relative to the clamping wall between a firing position, where the bracket member is distal from the clamping wall and is disposed in the withdrawn space, and a non-firing position, where the bracket member is proximate to the clamping wall and blocking at least a portion of the firing space. The linkage member resiliently biases the bracket member toward the non-firing position.

8 Claims, 9 Drawing Sheets

NAIL GUN NOZZLE MECHANISM AND NAIL GUN HAVING THE SAME

CROSS-REFERENCE TO RELATED APPLICATION

This application claims priority of Taiwanese Patent Application No. 110118129, filed on May 19, 2021.

FIELD

The disclosure relates to a power tool, especially relates to a nail gun having a nail gun nozzle mechanism.

BACKGROUND

A conventional nail gun nozzle mechanism is disclosed in Taiwanese Utility Model Patent No. M301110 as shown in FIG. 9. The conventional nail gun nozzle mechanism includes a first clamp section 61 and a second clamp section 62. The first clamp section 61 and the second clamp section 62 are meshed together in a gear mesh 63 that allows the first clamp section 61 and the second clamp section 62 to counter-rotate between an open position and a closed position. When the conventional nail gun nozzle mechanism fires a nail (not shown), the first clamp section 61 and the second clamp section 62 will be operated to the open position, and the nail will be fired from a firing channel 7 formed between the first clamp section 61 and the second clamp section 62. The conventional nail gun nozzle mechanism further includes a swivel spring (not shown) for resiliently biasing the first clamp section 61 and the second clamp section 62 toward the closed position and closing the firing channel 7.

However, the conventional nail gun nozzle mechanism has several disadvantages that occur over prolonged use. Firstly, dirt and foreign material may enter the gear mesh 63 and disrupt smooth counter-rotation between the first clamp section 61 and second clamp section 62. Secondly, by having two moving parts (the first clamp section 61 and the second clamp section 62), unequal displacement between the parts may distort the formation of the firing channel 7 and shift the trajectory of the nail being fired.

SUMMARY

Therefore, an object of the disclosure is to provide a nail gun nozzle mechanism that can alleviate at least one of the drawbacks of the prior art.

According to the disclosure, the nail gun nozzle mechanism is adapted to be connected to a nail-discharging end of a nail gun, the nail-discharging end defines a firing channel that extends along an axis. The nail gun nozzle mechanism includes a clamping wall, a retaining wall, and a switch unit. The clamping wall is adapted to be connected to the nail-discharging end, and defines a firing space that extends along the axis, that has opposite open ends along the axis, and that is adapted to be in spatial communication with the firing channel. The retaining wall is adapted to be connected to the nail-discharging end, and defines a withdrawn space that is offset from the axis and that is in spatial communication with the firing space. The switch unit includes a linkage member that is made of a resilient material, and that has an end immovably connected to the retaining wall, and a bracket member that is connected to an opposite end of the linkage member. The bracket member is movable relative to the clamping wall between a firing position, where the bracket member is distal from the clamping wall and is disposed in the withdrawn space, and a non-firing position, where the bracket member is proximate to the clamping wall and blocking at least a portion of the firing space. The linkage member resiliently biases the bracket member toward the non-firing position.

Another object of the present disclosure is to provide a nail gun having the abovementioned nail gun nozzle mechanism.

According to the disclosure, the nail gun includes the nail gun nozzle mechanism described above, a nail gun body module, and a magazine module. The nail gun body module has a drive unit, and a nail-discharging end that defines a firing channel extending in an axis. The magazine module is connected to the nail gun body module, and is adapted to hold a plurality of nails. The magazine module is adapted to dispense the nails successively into the firing channel, and the drive unit 31 is operable for driving the bracket member of the switch unit of the nail gun nozzle mechanism to move toward the firing position, and for driving the nail in the firing channel to be fired along the axis.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
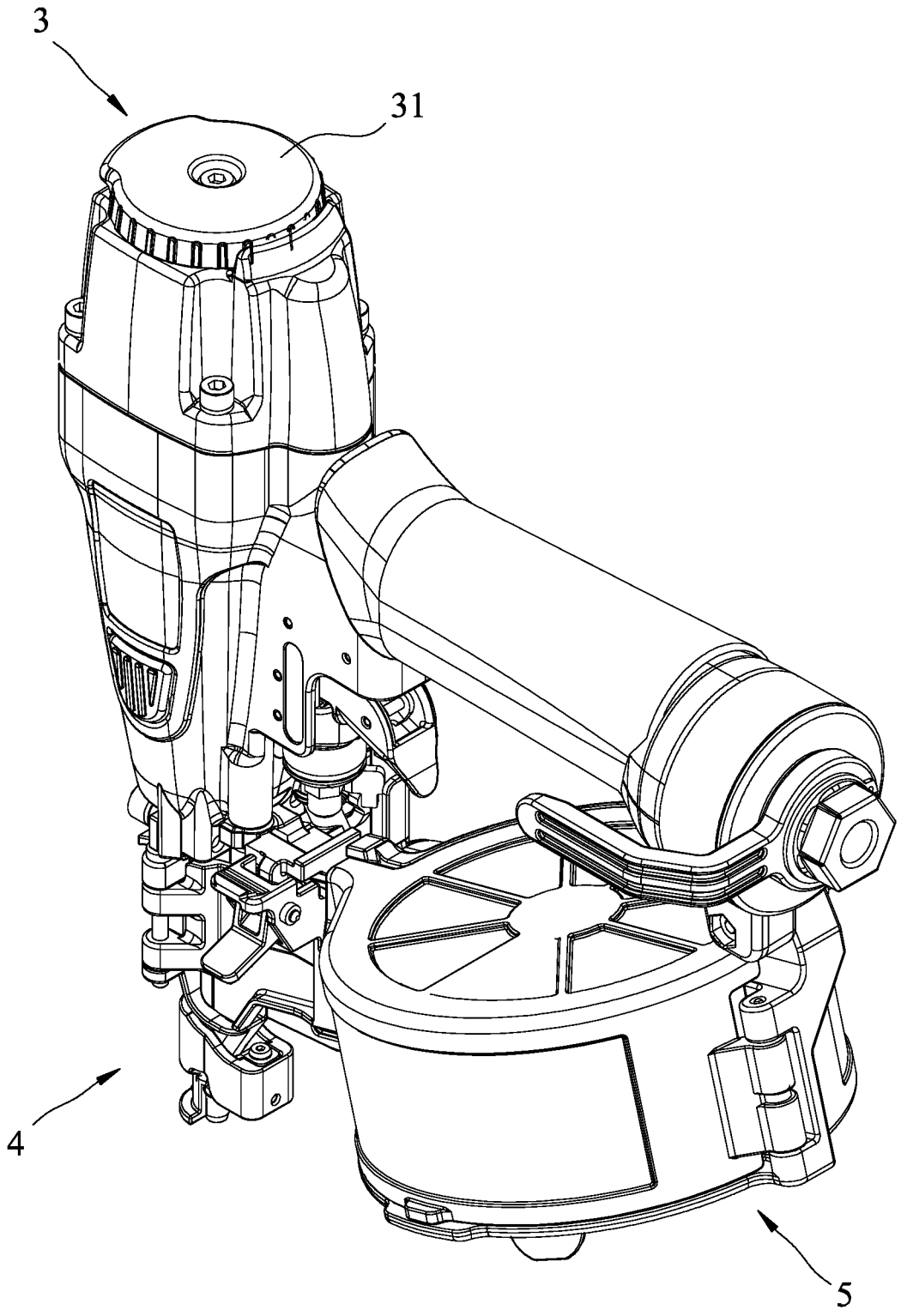
FIG. 1 is a perspective view illustrating a first embodiment of a nail gun according to the disclosure.
Figure 2:
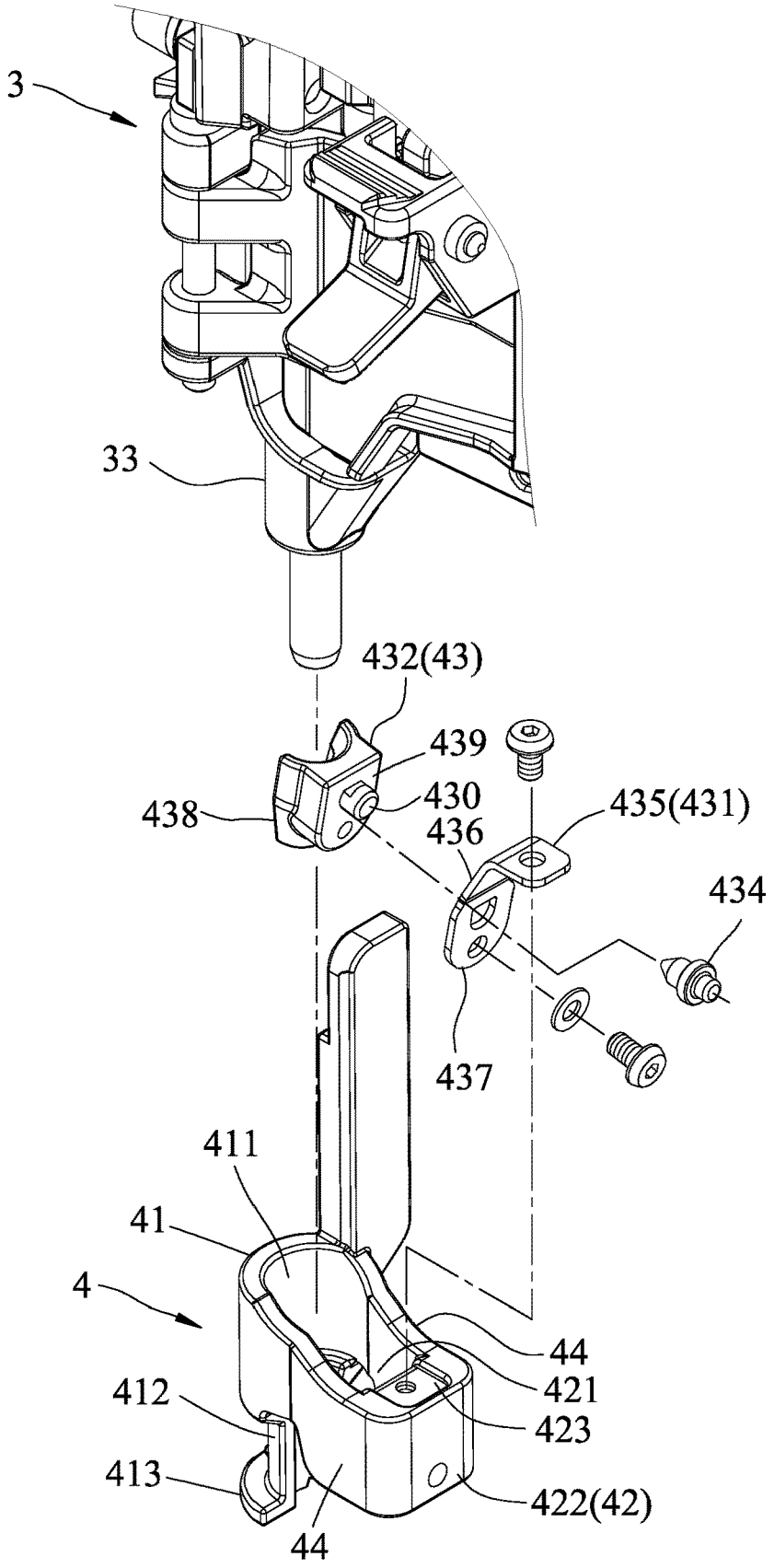
FIG. 2 is a fragmentary exploded perspective view illustrating the first embodiment.
Figure 3:
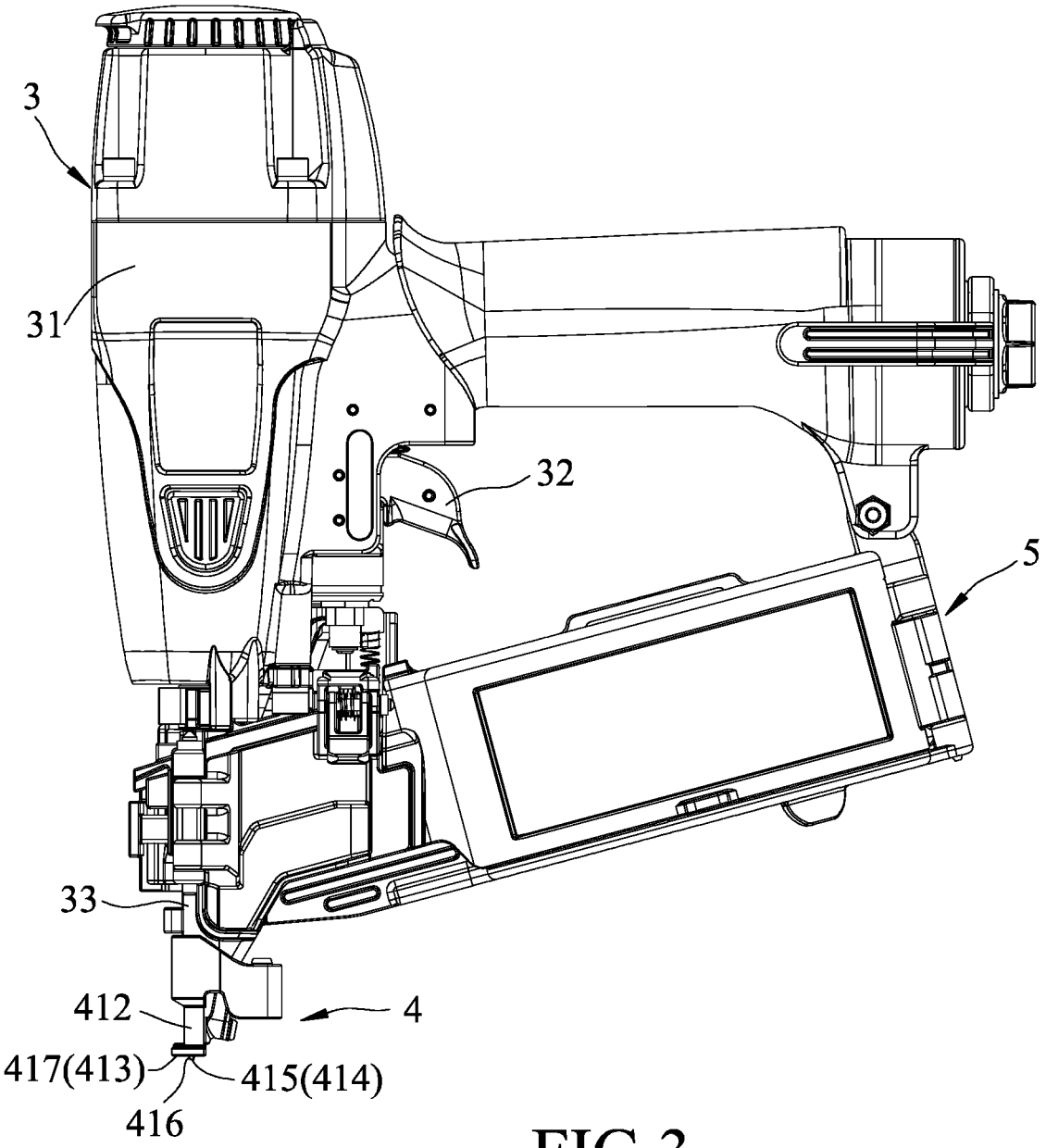
FIG. 3 is a side view illustrating the first embodiment.

Before the disclosure is described in greater detail, it should be noted that where considered appropriate, reference numerals or terminal portions of reference numerals have been repeated among the figures to indicate corresponding or analogous elements, which may optionally have similar characteristics.

Figure 4:
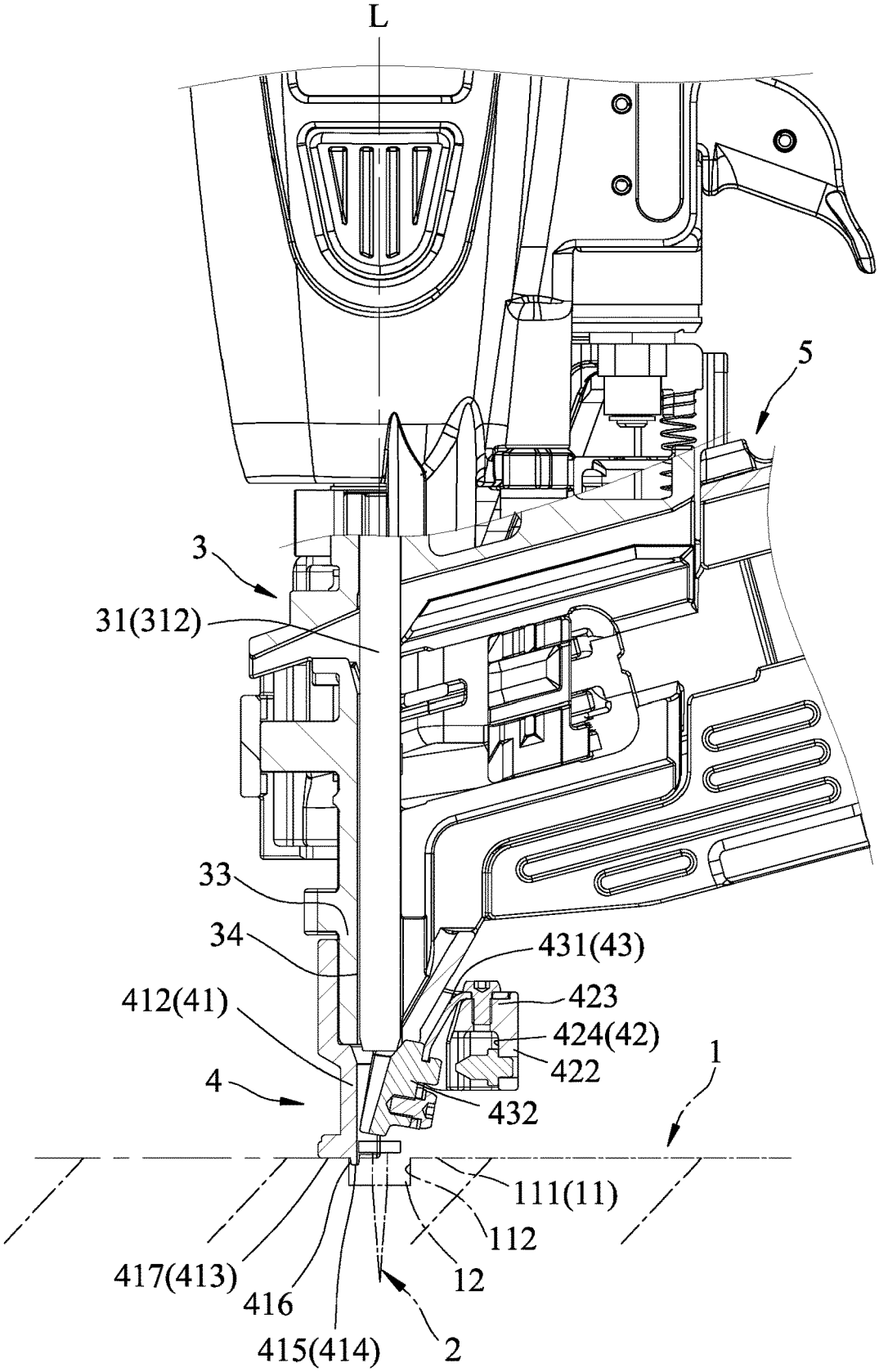
FIG. 4 is a fragmentary partially sectional view illustrating the first embodiment.

Referring to FIGS. 1 to 4, a first embodiment of a nail gun according to the present disclosure is shown. The nail gun is adapted to be braced against a workpiece 1 and successively fire a plurality of nails 2 (FIG. 4 shows only one of the nails 2).

The workpiece 1 has a main body 11, and a counterbore 12 formed in a top surface 111 of the main body 11. The main body 11 has a counterbore surface 112 encircling the counterbore 12.

The nail gun includes a nail gun body module 3, a nail gun nozzle mechanism 4, and a magazine module 5.

The nail gun body module 3 has a drive unit 31, an activation unit 32 that is operable to activate the drive unit 31, and a nail-discharging end 33. The nail-discharging end 33 defines a firing channel 34 that extends along an axis (L). The drive unit 31 has a piston rod 312 that is inserted in the firing channel 34 and that is movable along the axis (L).

Referring to FIGS. 2, 4, 5, and 6, the nail gun nozzle mechanism 4 is connected to the nail-discharging end 33 of the nail gun, and includes a clamping wall 41, a retaining wall 42, and a switch unit 43.

In this embodiment, the nail gun nozzle mechanism 4 further includes two side walls 44 spaced apart from each other, and connecting the retaining wall 42 to the clamping wall 41. The side walls 44, the retaining wall 42 and the clamping wall 41 cooperatively from a ring-shaped structure that surrounds and protrudes from the nail-discharging end 33.

The clamping wall 41 is connected to the nail-discharging end 33, and defines a firing space 411 that extends along the axis (L), that has opposite open ends along the axis (L), and that is in spatial communication with the firing channel 34 so that the piston rod 312 can be inserted into the firing space 411.

The clamping wall 41 has a base segment 412 adjacent to the firing space 411, and a guide segment 413 partially surrounding the base segment 412. The base segment 412 has a tip section 414 that protrudes from the guide segment 413 in a direction of the axis (L). The tip section 414 has a tip face 415 extending in a direction perpendicular to the axis (L), and a channel side surface 416 extending upwardly from the tip face 415 and connected to the guide segment 413. The guide segment 413 has a guide surface 417 that is parallel to the tip face 415.

The retaining wall 42 is connected to the nail-discharging end 33, and defines a withdrawn space 421 that is offset from the axis (L) and that is in spatial communication with the firing space 411. The retaining wall 42 has an end wall section 422 that extends in the direction parallel to the axis (L), and a transverse wall section 423 extending transversely from an end of the end wall section 422 towards the firing space 411. The end wall section 422 has a restricting surface 424 facing the firing space 411.

In this embodiment, the firing space 411 and the withdrawn space 421 are surrounded by the clamping wall 41, the side walls 44, and the retaining wall 42.

The switch unit 43 includes a linkage member 431 that is made of a resilient material, and that has an end immovably connected to the retaining wall 42, a bracket member 432 that is connected to an opposite end of the linkage member 431, and a stop block 434 that is connected to the retaining wall 42, and that protrudes into the withdrawn space 421.

The linkage member 431 of the switch unit 43 is configured as an elongated plate, and has a securing section 435, an inclined section 436, and an abutting section 437. The securing section 435 is immovably connected to the retaining wall 42. The inclined section 436 is inclined relative to the axis (L), and has a connecting end connected to the securing section 435, and a distal end opposite to the connecting end. The connecting end and the distal end are respectively distal from and proximate to the clamping wall 41. The abutting section 437 extends from the distal end of the inclined section 436 and abuts against the bracket member 432.

The bracket member 432 of the switch unit 43 has a proximate face 438, and a distal face 439 opposite to the proximate face 438. The abutting section 437 of the linkage member 431 abuts against the distal face 439 of the bracket member 432. The bracket member 432 further has a post 430 that extends from the distal face 439 through the abutting section 437.

The proximate face 438 has an inclined guiding portion 4381 and an extending guiding portion 4382 that are respectively proximate to and distal from the nail-discharging end 33. An extension of the inclined guiding portion 4381 and the axis (L) form an angle that is larger than an angle formed between the axis (L) and an extension of the extending guiding portion 4382.

Figure 5:
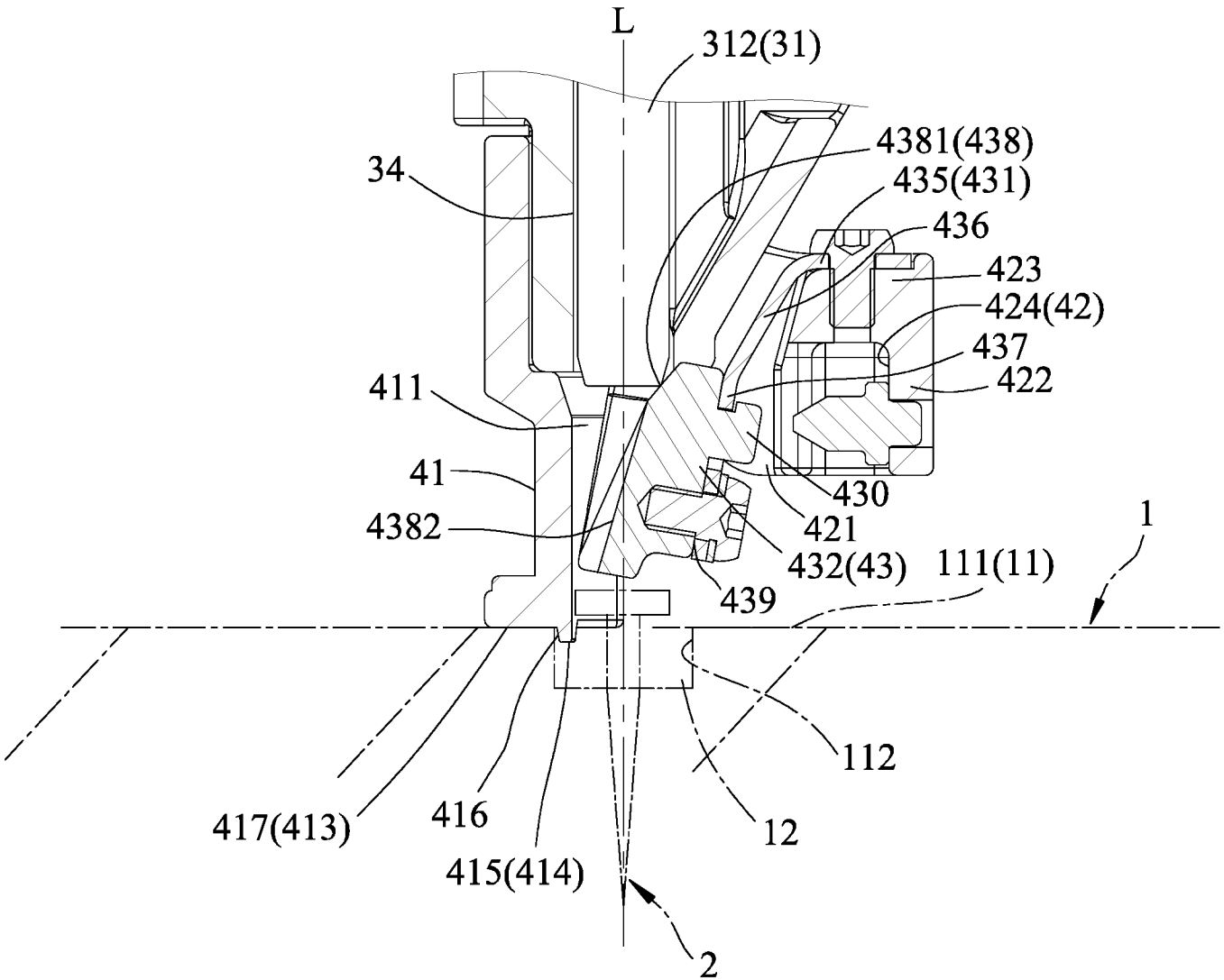
FIG. 5 is a fragmentary sectional view illustrating a bracket member of the first embodiment in a non-firing position.
Figure 6:
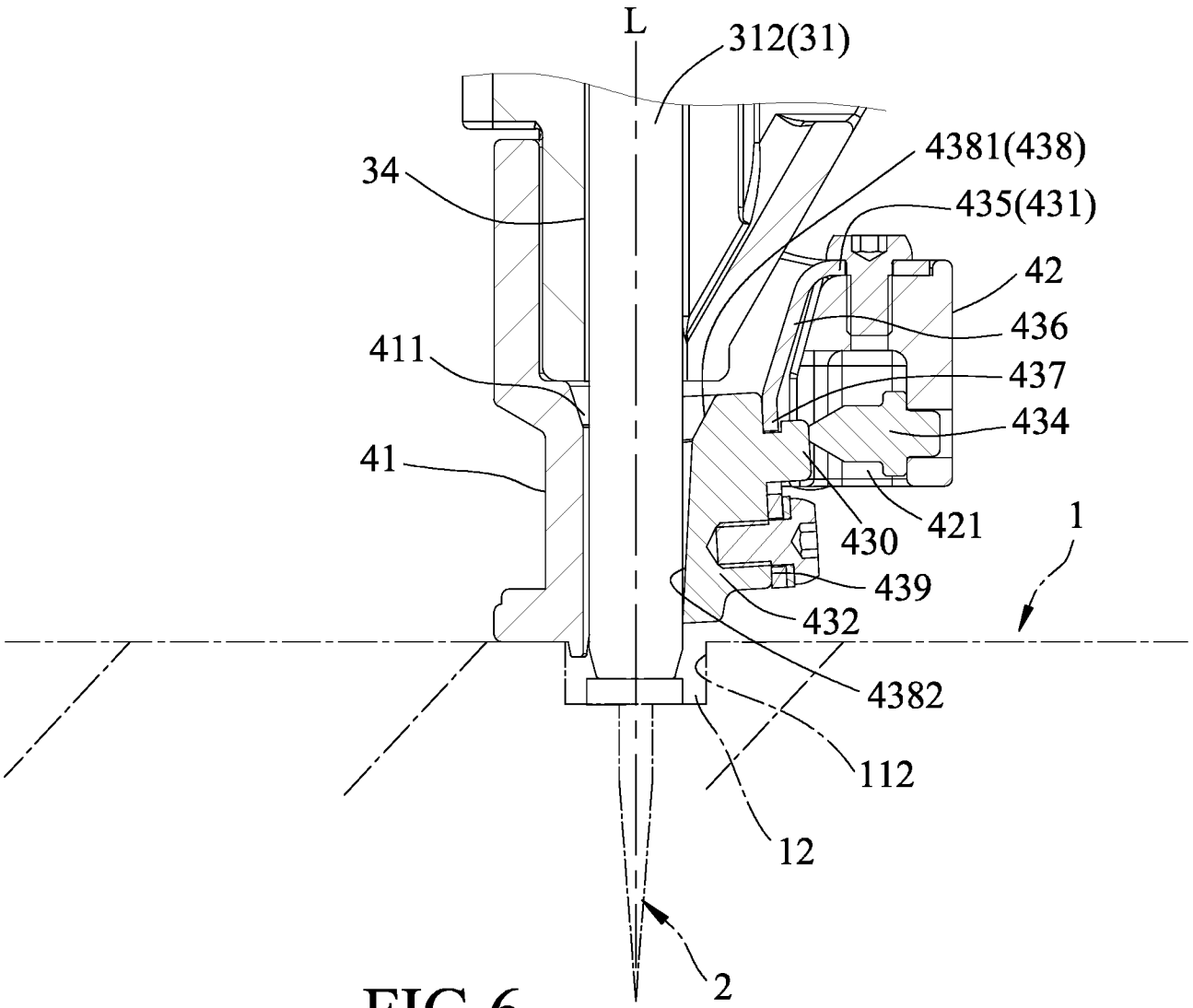
FIG. 6 is a fragmentary sectional view of the first embodiment, illustrating the bracket member in a firing-position.

The bracket member 432 is movable relative to the clamping wall 41 between a firing position (as shown in FIG. 6) and a non-firing position (as shown in FIG. 5).

When in the firing position, the bracket member 432 is distal from the clamping wall 41 and is disposed in the withdrawn space 421.

In the non-firing position, the bracket member 432 is proximate to the clamping wall 41 and blocks at least a portion of the firing space 411.

The linkage member 431 resiliently biases the bracket member 432 toward the non-firing position. When the bracket member 432 is in the firing position, the post 430 abuts against the stop block 434, and the bracket member 432 is prevented from moving in a direction that is away from the clamping wall 41.

The magazine module 5 is connected to the nail gun body module 3, and is adapted to hold a plurality of nails 2. The magazine module 5 is adapted to dispense the nails 2 successively into the firing channel 34. The drive unit 31 is operable for driving the bracket member 432 of the switch unit 43 of the nail gun nozzle mechanism 4 to move toward the firing position, and for driving the nail 2 in the firing channel 34 to be fired along the axis (L).

When using the nail gun, the guide surface 417 of the guide segment 413 is bought to abut against the top surface 111 of the workpiece 1, the tip section 414 is extended into the counterbore 12. Next, the activation unit 32 is operated to activate the drive unit 31, which drives the piston rod 312 to move along the axis (L) in the firing space 411. The user can also bring the channel side surface 416 of the tip section 414 to be in contact with the counterbore surface 112 of the workpiece 1 as desired. As such, the nail-discharging end 33 can more stably abut against the workpiece 1.

When the piston rod 312 moves along the axis (L), the piston rod 312 is able to push the nail 2 in the firing channel 34. When the piston rod 312 moves into the firing space 411, the piston rod 312 will abut against the inclined guiding portion 4381 and the extending guiding portion 4382 of the proximate face 438 of the bracket member 432, and as the piston rod 312 moves further the bracket member 432 will be moved away from the clamping wall 41. When the bracket member 432 is moved to the firing position (as shown in FIG. 6), the bracket member 432 is in the withdrawn space 421, and the piston rod 312 can move along the firing space 411 and push the nail 2 to be fired from the firing space 411.

After the nail 2 has been fired, the piston rod 312 moves reversely along the axis (L), the bracket member 432 will be resiliently biased by the linkage member 431 to move to the non-firing position (as shown in FIG. 5) to be proximate to the clamping wall 41 and block a portion of the firing space 411.

Therefore, the activation unit 32 is operable to activate the drive unit 31 and drive the piston rod 312 to reciprocate along the axis (L) in the firing space 411 to successively fire the nails 2 by virtue of the nail gun nozzle mechanism 4.

In the operation of the nail gun described above, the bracket member 432 moves to the non-firing position to block the firing channel 34, and to the firing position to un-block the firing channel 34. Throughout the operation of the nail gun the clamping wall 41 remains stationary, so that unequal displacement of the clamping wall 41 and the bracket member 432 may be prevented since only one of them is movable, which can prevent shifting the position of the firing channel 34 when the nail gun is operating. In this embodiment, because the linkage member 431 is resiliently biasing the bracket member 432, the bracket member 431 may stably remain in the non-firing position before being pushed by the piston rod 312. Additionally, this allows the bracket member 432 to stably abut against the piston rod 312 during movement of the bracket member 432 between the firing and non-firing positions.

It should be mentioned that, by virtue of the stop block 434 and the post 430, when the bracket member 432 is in the firing position, the post 430 abuts against the stop block 434, and the bracket member 432 is prevented from moving in the direction that is away from the clamping wall 41. Therefore, the range of movement of the bracket member 432 is restricted by the post 430, and shifting of the firing channel 34 can be further prevented.

Furthermore, because the linkage member 431 of the switch unit 43 is configured as an elongated plate, the securing section 435 that is immovably connected to the retaining wall 42, and the abutting section 437 that abuts against the bracket member 432 are sufficiently large in surface area to provide structural support which can prevent wobbling.

It should be especially noted that, in this embodiment, the clamping wall 41 has the base segment 412 and the guide segment 413. The base segment 412 has the tip section 414 that has the channel side surface 416, and the guide segment 413 has the guide surface 417. The channel side surface 416 and the guide surface 417 can be brought to respectively abut against the counterbore surface 112 and the top surface 111 of the workpiece 1. However, this is not a limitation, and in other embodiments, the clamping wall 41 may be shaped differently (such as only having the base segment 412 and not having the guide segment 413) to accommodate various different shapes that the workpiece 1 may have.

In this embodiment, the side walls 44, the clamping wall 41, and the retaining wall 42 of the nail gun nozzle mechanism 4 form a ring that surrounds and protrudes from the nail-discharging end 33, but is not thus limited to this configuration. In other embodiments, the nail gun nozzle mechanism 4 may not include the side walls 44, and only include the clamping wall 41 and the retaining wall 42 connected to the nail-discharging end 33, while retaining the same functionality.

Figure 7:
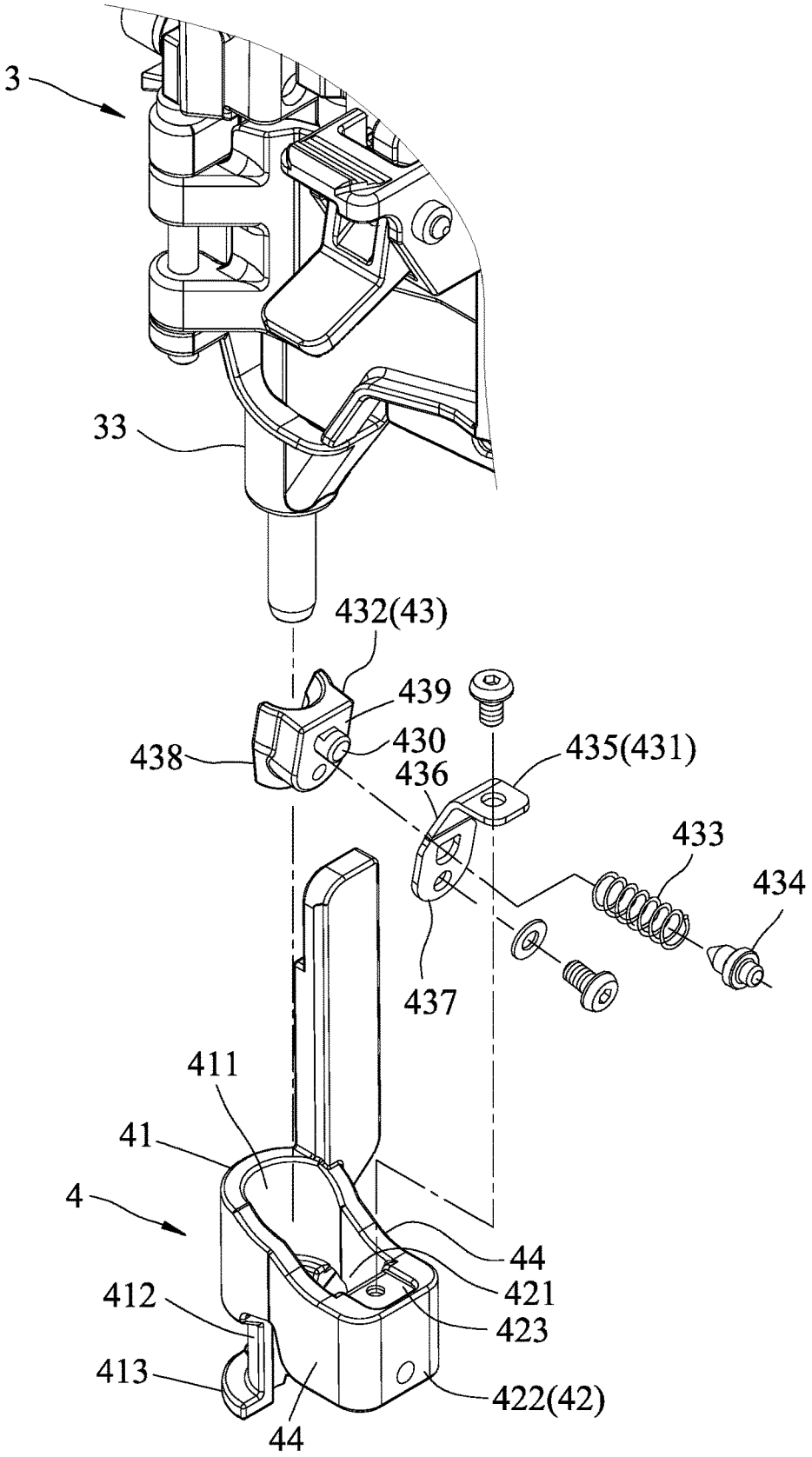
FIG. 7 is a fragmentary exploded perspective view illustrating a second embodiment of the nail gun according to the disclosure.
Figure 8:
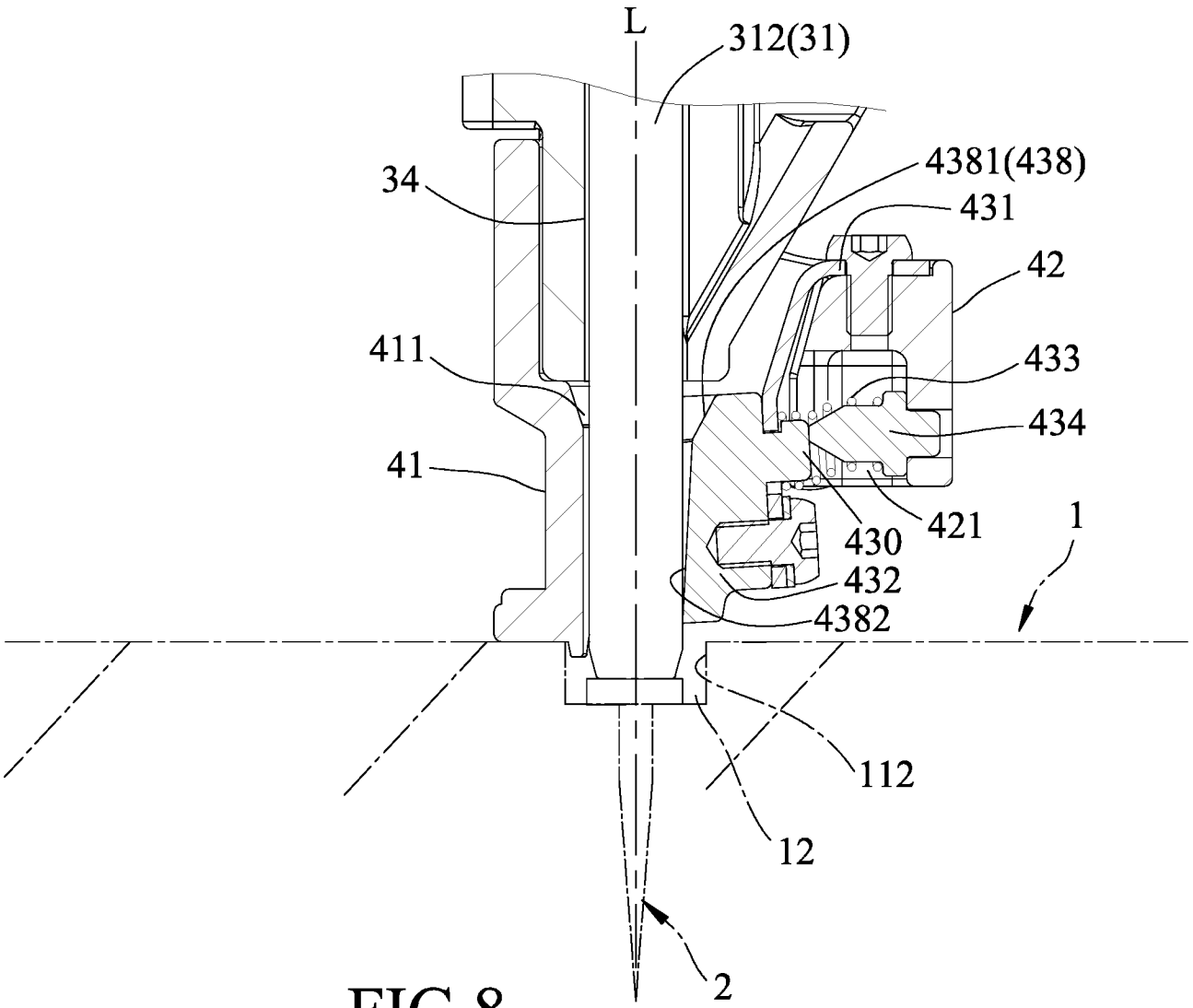
FIG. 8 is a fragmentary sectional view illustrating a bracket member of the second embodiment in the firing-position.
Figure 9:
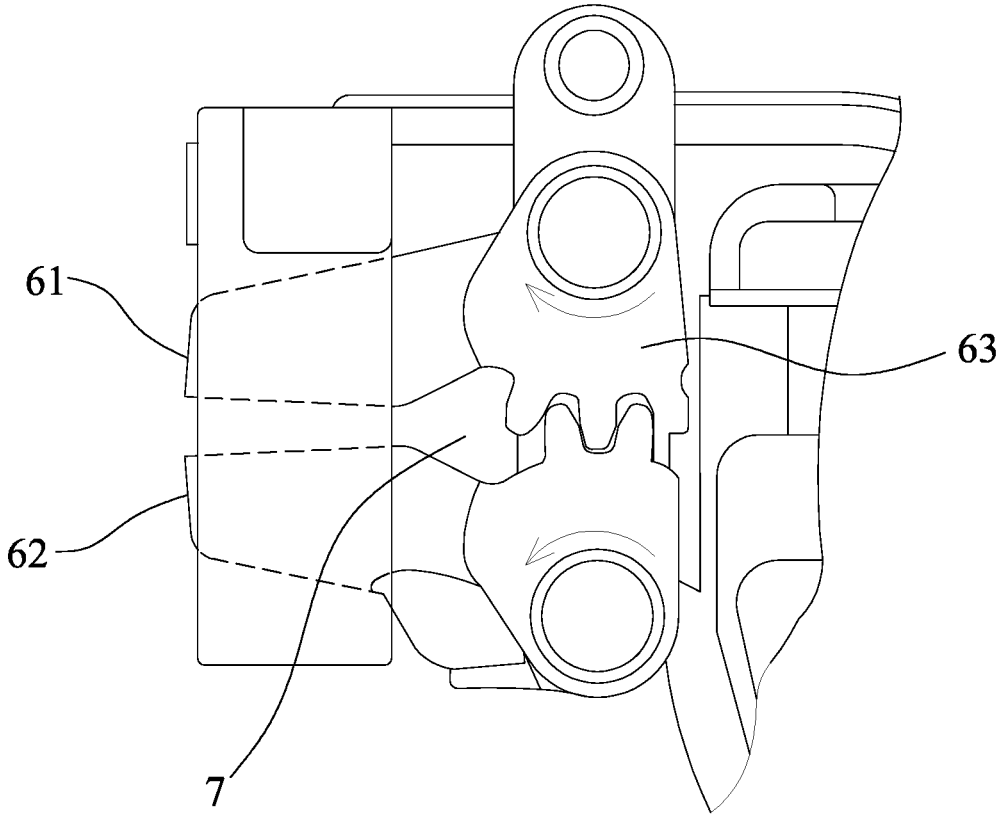
FIG. 9 is a fragmentary side view of a conventional nail gun.

FIGS. 7 and 8 illustrates a second embodiment of the nail gun that is similar to the first embodiment except for the differences which will be described in the following.

In this embodiment, the switch unit 43 of the nail gun nozzle mechanism 4 further includes a resilient member 433 that is disposed between and abuts against the stop block 434 and the abutting section 437. In this embodiment, the resilient member 433 is a compression spring that is sleeved on the post 430 and the stop block 434.

The resilient member 433 provides a restoring force which pushes the bracket member 432 toward the non-firing position. Such restoring force increases the total force exerted on the bracket member 432, which has been biased by the linkage member 431, toward the non-firing position. When the bracket member 432 is in the firing position, the resilient member 433 is compressed, the post 430 abuts against the stop block 434, and the bracket member 432 is prevented from moving in the direction that is away from the clamping wall 41.

Because the resilient member 433 provides the restoring force which pushes the bracket member 432 toward the non-firing position, therefore the bracket member 432 can be stably maintained in the non-firing position, and can stably abut against the piston rod 312 during movement of the bracket member 432 between the firing and non-firing positions.

In summary, in the nail gun according to the present disclosure, the bracket member 432 is movable relative to the clamping wall 41 to be distal from and proximate to the clamping wall 41, while the clamping wall 41 remains stationary, thereby preventing unequal displacement of the clamping wall 41 and the bracket member 432 which would lead to shifting the position of the firing channel 34 when the nail gun is in operation. Additionally, in the second embodiment, by virtue of the resilient member 433 and the linkage member 431 cooperatively pushing the bracket member 432 toward the non-firing position, the bracket member 432 can stably abut against the piston rod 312 during movement of the bracket member 432 between the firing and non-firing positions, and the stability of the nail gun can be maintained when in operation.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A nail gun nozzle mechanism adapted to be connected to a nail-discharging end of a nail gun, the nail-discharging end defining a firing channel that extends along an axis, said nail gun nozzle mechanism comprising:

a clamping wall adapted to be connected to the nail-discharging end, and defining a firing space that extends along the axis, that has opposite open ends along the axis, and that is adapted to be in spatial communication with the firing channel;

a retaining wall adapted to be connected to the nail-discharging end, and defining a withdrawn space that is offset from the axis and that is in spatial communication with said firing space;

a switch unit including a linkage member that is made of a resilient material, and that has an end immovably connected to said retaining wall, and a bracket member that is connected to an opposite end of said linkage member;

wherein said bracket member is movable relative to said clamping wall between a firing position, where said bracket member is distal from said clamping wall and is disposed in said withdrawn space, and a non-firing position, where said bracket member is proximate to said clamping wall and blocking at least a portion of said firing space, said linkage member resiliently biasing said bracket member toward the non-firing position, wherein said linkage member of said switch unit is configured as an elongated plate and includes:

a securing section that is immovably connected to said retaining wall;

an inclined section that is inclined relative to the axis, and that has a connecting end connected to said securing section, and a distal end opposite to said connecting end, said connecting end and said distal end being respectively distal from and proximate to said clamping wall; and an abutting section that extends from said distal end of said inclined section and that abuts against said bracket member.

2. The nail gun nozzle mechanism as claimed in claim 1, wherein said switch unit further includes a resilient member that is disposed between said retaining wall and said abutting section, and that provides a restoring force which pushes said bracket member toward the non-firing position.

3. The nail gun nozzle mechanism as claimed in claim 2, wherein:

said bracket member of said switch unit has a post that extends through said abutting section;

said switch unit further includes a stop block that is connected to said retaining wall, and that protrudes into said withdrawn space;

said resilient member is a compression spring, and has an end portion that is sleeved on said post and that abuts against said abutting section, and an opposite end portion that is sleeved on and that abuts against said stop block; and when said bracket member is in the firing position, said resilient member is compressed, said post abuts against said stop block, and said bracket member is prevented from moving in a direction that is away from said clamping wall.

4. The nail gun nozzle mechanism as claimed in claim 1, further comprising two side walls spaced apart from each other and connecting said retaining wall to said clamping wall, said side walls, said retaining wall and said clamping wall being adapted to surround and protrude from said nail-discharging end, and defining said firing space and said withdrawn space.

5. A nail gun comprising:

said nail gun nozzle mechanism as claimed in claim 1;

a nail gun body module having a drive unit, and the nail-discharging end that defines the firing channel extending in the axis;

a magazine module connected to said nail gun body module, and being adapted to hold a plurality of nails;

wherein said magazine module is adapted to dispense the nails successively into said firing channel, and said drive unit is operable for driving said bracket member of said switch unit of said nail gun nozzle mechanism to move toward the firing position, and for driving the nail in the firing channel to be fired along the axis;

wherein said linkage member of said switch unit of said nail gun nozzle mechanism is configured as an elongated plate; and includes:

a securing section that is immovably connected to said retaining wall;

an inclined section that is inclined relative to the axis, and that has a connecting end connected to said securing section, and a distal end opposite to said connecting end, said connecting end and said distal end being respectively distal from and proximate to said clamping wall; and an abutting section that extends from said distal end of said inclined section and that abuts against said bracket member.

6. The nail gun as claimed in claim 5, wherein said switch unit of said nail gun mechanism further includes a resilient member that is disposed between said retaining wall and said abutting section, and that provides a restoring force which pushes said bracket member toward the non-firing position.

7. The nail gun as claimed in claim 6, wherein:

said bracket member of said switch unit of said nail gun mechanism has a post that extends through said abutting section;

said switch unit further includes a stop block that is connected to said retaining wall, and that protrudes into said withdrawn space;

said resilient member is a compression spring, and has an end portion that is sleeved on said post and that abuts against said abutting section, and an opposite end portion that is sleeved on and that abuts against said stop block; and when said bracket member is in the firing position, said resilient member is compressed, said post abuts against said stop block, and said bracket member is prevented from moving in a direction away from said clamping wall.

8. The nail gun as claimed in claim 5, wherein:

said nail gun mechanism further includes two side walls that are spaced apart from each other, and that connect said retaining wall to said clamping wall; and said side walls, said retaining wall and said clamping wall surround and protrude from said nail-discharging end, and define said firing space and said withdrawn space.

* * * * *